US006584621B2

(12) United States Patent
Kim

(10) Patent No.: US 6,584,621 B2
(45) Date of Patent: Jul. 1, 2003

(54) TOILET SEAT WITH TWIN PROTRUSIONS HAVING AN EGG SHAPE

(76) Inventor: Yoon Hwan Kim, 1801 N. 107 St. 301, Seattle, WA (US) 98133

( * ) Notice: Subject to any disclaimer, the term of this patent is extended or adjusted under 35 U.S.C. 154(b) by 0 days.

(21) Appl. No.: 10/035,510

(22) Filed: Oct. 26, 2001

(65) Prior Publication Data

US 2002/0053103 A1 May 9, 2002

(30) Foreign Application Priority Data

Oct. 30, 2000 (KR) ..... 2000-64024

(51) Int. Cl.[7] ..... A47K 13/00
(52) U.S. Cl. ..... 4/237
(58) Field of Search ..... 4/234, 237

(56) References Cited

U.S. PATENT DOCUMENTS 2,256,994 A * 9/1941 Warshaw ..... 4/237
4,048,679 A * 9/1977 Garnett ..... 4/237
4,189,794 A * 2/1980 Aleman-Mucino ..... 4/237
4,244,063 A * 1/1981 Bayard ..... 4/237
4,457,029 A * 7/1984 Matthews ..... 4/237

* cited by examiner

*Primary Examiner*—Charles E. Phillips
(74) *Attorney, Agent, or Firm*—Flynn, Thiel, Boutell & Tanis, P.C.

(57) ABSTRACT

A toilet bowl includes a toilet seat, a seat cover and connections which are to be operated by mutually connecting backward tail ends of the seat and backward tail ends of the cover. The toilet seat is integrally formed with egg shaped twin protrusions on a backward tail end central region of the seat by an injection molding process. The twin protrusions include a left protrusion and a right protrusion, top surfaces on the protrusions, a front groove and a rear groove, and a boundary surface formed between the protrusions by grooves. By repeated rocking type motions for the compression and relaxation motions of each of the gluteal muscles of the user on the top surfaces of the seat having the twin protrusions, the user massages lower regions of the rectum of the user in cyclic motions of the rectum as in a conventional massage mode. The excrement accumulated in the rectum is changed into the activation state, and an easy evacuation can be made by a user for evacuation in a normal respiration pressure state, without any application of strong respiration pressure in the abdomen and without taking various medicines or other remedies.

16 Claims, 9 Drawing Sheets

TOILET SEAT WITH TWIN PROTRUSIONS HAVING AN EGG SHAPE

FIELD OF THE INVENTION

The present invention relates to a toilet to which twin protrusions having an egg shape are formed.

BACKGROUND OF THE INVENTION

In general, when a user wishes to discharge excrement on the conventional toilet seat of the toilet bowl, excrement including hard feces and hard agglomerations in the rectum of the user are discharged through the anus of the user by applying strong respiration pressure in the abdomen of the user.

When the strong respiration pressure is applied in the lower abdomen during evacuation on the toilet seat, the old and the weak who have a weak rectum, patients who have geriatric diseases or patients who have been recently operated on at the outer and inner regions of the abdomen can be dealt a fatal blow to their bodies depending on their condition.

Accordingly, easy evacuation of defecation for the above disabled or ill persons is required in the normal respiration pressure state without application of strong respiration pressure to the abdomen.

For evacuation, some people use various medicines or remedies intended to make evacuation easy. However, such medicines and remedies cause various side effects and complications.

Further, hard feces or hard agglomerations accumulated in the rectum of the user ferment, and give rise to various diseases, and paralysis of the rectum can be produced due to evacuation troubles for agglutinated residues and hard agglomerations in the rectum.

Accordingly, efficient discharges for excrements such as accumulated residues and hard agglomerations in the rectum must be carried out by cyclic motions of the rectum when in inclination on the stool, as disclosed herein. The invention allows those unable to properly evacuate to be easily evacuated by the cyclic motions of the rectum without taking various medicines or other remedies, and without application of strong respiration pressure in the abdomen, while remaining in the normal respiration pressure state.

In order to overcome defects as described above, an object of the present invention is to provide a toilet seat of a toilet bowl, in which twin protrusions having egg shapes are integrally formed on a backward tail end central region of the seat by an injection molding process. The seat enables easy evacuation or defecation by the person physically unable to defecate.

Another object of the present invention is to provide a toilet seat of a toilet bowl having twin protrusions with each protrusion having an egg shape, in which a prearranged prevention may be made for various diseases such as an aneurysm, fainting, stroke or the cerebral vascular burst produced by rising blood pressure which is often experienced when a strong pressure through respiration is applied in the abdomen by a person for evacuation or defecation. The toilet seat enables an easy evacuation made in the normal respiration state without application of strong pressure for respiration in the abdomen.

Further, an additional object of the present invention is to provide a toilet seat for a toilet bowl having twin protrusions with each an egg shape, so that excrements including hard feces and hard agglomerations accumulated in the rectum of a user may be easily discharged through the anus of the user by repeating compression and relaxation motions for the gluteal muscles of the user without application of strong pressure though respiration in the abdomen of the user when evacuating.

Finally, an object of the present invention is to provide a toilet seat of a toilet bowl forming egg shaped twin protrusions, in which a person may easily and suitably evacuate while on the seat of the toilet bowl, without application of strong respiration pressure in the abdomen of the person who remains in a normal respiration state.

SUMMARY OF THE INVENTION

The present invention relates to a toilet seat for a toilet bowl which comprises a toilet seat, a lid cover protecting the seat, and connections which are to be operated by mutually connecting backward tail ends of the seat and the lid, wherein twin protrusions each having an egg shape are integrally formed on a backward tail end central region of the seat by injection molding with thermoplastic resins, and the lid cover is formed with a curved surface in order to protect the twin protrusions.

The egg shaped twin protrusions as major structures of the present invention, comprise a left protrusion and a right protrusion. The twin protrusions have top surfaces thereon, a front groove formed in a front direction between the left protrusion and the right protrusion, a rear groove formed in a rear direction between the left protrusion and the right protrusion, and a boundary surface formed by the grooves between the protrusions.

Further, a front structure of the twin protrusions is formed on the central region positioned at an angle of 75°. In addition, a rear structure of the twin protrusions is formed on the central region positioned at an angle of 85°.

The front and rear structure of the twin protrusions preferably are not at a vertical position on the central region of the seat in view of an evacuation posture of a person using the toilet bowl.

The protrusions 2*a* and 2*b* each have a symmetrical structure and can be formed with a hollow state. However, interiors of the protrusions are, preferably, fully filled with thermoplastics or thermoplastic resins, when molded by an injection molding.

While the seat 1 and the protrusions 2*a* and 2*b* are molded by the injection molding, they may be formed by other known methods.

The protrusions according to the present invention enable easy evacuation by being formed in the most suitable manner for an evacuation posture of the user on the toilet bowl so that the user maintains normal breathing (or respiration) during evacuation.

Accordingly, top surfaces 11 of the protrusions 2*a* and 2*b* each have contact surfaces for gluteal muscles on gluteal regions of the user during the evacuation. Optimum conditions which contact the top surfaces with the gluteal muscles of the user are as follows.

The top surfaces 11 each are formed with a circular arc having an angle of 180°. When the gluteal muscles of the user are each compressed on the top surfaces 11, a compressed depth of each gluteal muscle must be at least the same height of the protrusions 2*a* and 2*b*. Each top surface 11 has a circular arc of 180°.

By providing such optimum conditions on the top surfaces 11, an upper body of the user can repeat forward and backward motions on the top surfaces when the user is seated on the seat of the toilet bowl 13. The forward and backward motions are similar to motion in a rocking chair. By the repeated motions of the upper body of the user, a lower region of the rectum of the user is compressed and then relaxed.

Accordingly, various types of excrement in the rectum of the user are changed from an accumulated state into an active state. Thus, with various excrement including hard and loose feces in the rectum of the user in an active state, the excrement is easily discharged through the anus of the user.

The physical pressure, as obtained by the forward and backward motions of the upper body of the user on the top surfaces is considerably greater than the pressure applied in the lower abdomen or belly of the user by breathing (or respiration). Thus, various excrements accumulated in the rectum of the user may easily be discharged through the anus of the user.

Each of the protrusions having an egg shape preferably have the following details:

1. The height of the protrusions preferably are each in a range of 1 inch to 2 inches. When the protrusions are formed by injection molding, the height of each protrusion is controlled to conform to the thickness of the gluteal muscles of the user.

2. When the gluteal muscles of the gluteal regions of the user contact the top surfaces, the muscles can be alternately compressed by the compression and relaxation motions.

3. When the gluteal muscles of the user are compressed by the weight of the user on the top surfaces of the protrusions having 1 inch in height, the compressed depth of each gluteal muscle is preferably at least 1 inch.

4. The diameter of each of the protrusions is in a range of 1 inch to 2 inches.

5. When the thickness of each of the gluteal muscles of the user is 1 inch, the diameter of each of the protrusions preferably is 1 inch in height.

6. The compressed depth for each of the gluteal muscles of the user can be 1 inch.

7. When the thickness of each of the gluteal muscles of the user is 1½ inches, each of the protrusions is 1½ inches in height and in diameter, respectively.

8. The rear groove (that is, a protecting groove for the coccyx) protects and avoids contact and friction between the coccyx of the user and the protrusions when the user wishes to evacuate while sitting on the seat of the toilet bowl. The coccyx of the user is positioned in the rear groove when the user evacuates while on the seat.

9. The front groove (that is, a protecting groove for the ischium and the pubis) protects by avoiding contact and friction between the ischium and the pubis of the user with the protrusions when the user is on the seat of the toilet bowl. The pubis and the ischium of the user are placed in the front groove when the user prepares to evacuate while on the seat.

10. An entire structure of twin protrusions is formed by having the structure on the rear surface thereof at an angle of 85° in view of the rear groove; by placing the structure on the front surface at an angle of 75° in view of the front groove; by providing the top surfaces of each protrusion with a circular arc of about 180°; by providing the twin protrusions at least at a same length to the compressed depth of each of the gluteal muscles of the user in height and diameter of each of the protrusions; by providing the structure on the rear groove with an inverse "W" shape; and by providing the structure on the front groove with a "W" shape.

11. When the user repeats forward and backward motions of each of the gluteal muscles by the upper body of the user through the leg motion of the user on the top surfaces of the seat on the toilet bowl, in one instance, each of the gluteal muscles of the user is compressed to a same compressed depth of at least a height of each of the protrusions. The compressed depth of each of the gluteal muscles on the top surfaces is caused by the backward motion of the upper body of the user through the leg motion backwardly of the user on the seat of the toilet bowl. In another case, each of the gluteal muscles of the user at the compressed depth is returned from the compressed gluteal muscles into relaxed gluteal muscles by the forward motion of the upper body of the user on the top surfaces through forward leg motion. The motion of the user is repeated preferably 3 to 6 times for the compressed and relaxed motions of each of the gluteal muscles.

By the repeated compression and relaxation motions for each of the gluteal muscles of the user, the user massages the lower regions of the rectum in a conventional massage mode. Accordingly, the various excrement including hard feces and hard agglomerates in the rectum of the user are changed from the accumulated state into the activation state.

The pressure motions produced from the accumulated state into the activation state in the rectum through the compression and relaxation motions on the top surfaces are considerably greater than pressure motions on the excrement in the rectum of the user from strong pressure in the lower belly or abdomen through the respiration of the user.

Accordingly, the present invention provides a seat for the toilet bowl which enables easy evacuation during normal respiration of the user without application of strong pressure in the abdomen through the respiration of the user.

The compression and relaxation motions for each of the gluteal muscles of the user under the preferred conditions of the twin protrusions, as described above, provide a technical means which can substitute for the strong pressure in the abdomen generated by forceful respiration.

The lower regions of the rectum of the user are compressed and relaxed by the compressing and relaxing motions of each of the gluteal muscles of the user on the top surfaces 11, and the excrement including the hard feces and hard agglomerates in the rectum are changed from the accumulated state into the activation state.

By such a change for the excrement in the rectum of the user, the excrement is discharged through the anal canal and the anus which are retracted and dilated.

The compression and relaxation motions of each of the gluteal muscles of the user on the top surfaces according to the present invention, have significant and important technical effects for the present invention, and must be described in greater detail.

Details on the compression and relaxation motions of each of the gluteal muscles of the user on the top surfaces of the protrusions are as follows.

When the user has an evacuation posture which is pleasant and stable on the top surfaces of the protrusions (that is, forwardly bending posture of the upper body of the user on the top surfaces at an angle of from 65° to 85°), each of the gluteal muscles of the user is compressed on the top surfaces by weight from the upper body of the user and an initial compression depth (Di) is formed on each of the gluteal muscles.

The compression depth Di is an initial compression depth for each of the gluteal muscles on the top surfaces from the weight of the upper body of the user in the forwardly bending evacuation posture of the user. Soles on the feet of the user are on an arranged surface or the toilet base mat or the toilet of the toilet bowl. The evacuation posture of the user has an initial compression depth Di for each of the gluteal muscles on the top surfaces. Then the user applies force to the soles and pushes backwardly through the waist of the user so as to form a vertical posture of the upper body of the user with an angle of 90° or more.

By such backward pushing action of the upper body of the user through the waist on the top surfaces with an angle of 90° or more, the compressed gluteal muscles each having the initial compression depth Di are more deeply compressed by the weight of the upper body being at 90° or more on the top surfaces. When the upper body of the user is placed on the top surfaces at an angle of 90° or more by the backward pushing action through the waist of the user, a final compression depth for each gluteal muscle is formed at a depth greater than the initial compression depth Di.

The final compression depth for each of the gluteal muscles on the top surfaces is expressed as "Df".

Accordingly, when the difference (Df–Di) of the compression depth increases, the compression motion for each of the gluteal muscles becomes larger, and the relaxation motion becomes larger.

Thus, the user applies force (pressure) through their feet to carry out a backward pushing action through the waist (or the upper body) and the legs of the user. The upper body of the user moves from the evacuation posture (a forwardly bending posture having a range of from 65° to 85°) to the backward evacuation posture having an angle of 90° or more (the vertical upper body) by the backward motion of the waist on the top surfaces.

At the same time, each of the gluteal muscles of the user having the initial compressed depth Di on the top surfaces is additionally more deeply compressed by pressure through the weight of the upper body of the user at 90° or more. Finally, the compressed depth Df for each of the gluteal muscles is determined at the top surfaces.

Again, the upper body of the user at an angle of 90° or more on the top surfaces is returned to the forwardly bending evacuation posture at 65° to 85° from the vertical evacuation posture. The final compression depth Df for each of the gluteal muscles is returned to the initial compression depth Di for each of the gluteal muscles in the originally compressed state at the top surfaces.

the initial compression depth Di for each of the gluteal muscles into the final or maximum compression depth Df is defined as "compression motion of the gluteal muscles". A motion which changes from the maximum compression depth Df of the gluteal muscles to the initial compression depth of the gluteal muscles is defined as a "relaxation motion of the gluteal muscles" for the present invention.

When repeating the compression and relaxation motions of the gluteal muscles of the user, when the gluteal muscles are in the Df state: the anus, the anal canal and lower regions of the rectum of the user are compressed as in the conventional massage mode. Excrement, including hard agglomerates in the rectum of the user, is changed from the accumulated state into the activation state, and the excrement in the rectum of the user is discharged by opening of the anus through action of the anus and the anal canal of the user.

As a result of clinical demonstrations, the compression and relaxation motions of the gluteal muscles are preferably repeated in a range of from 3 times to 6 times.

Further, when the user repeats a forward motion and a backward motion of the upper body from the forwardly bending evacuation posture of the user, the gluteal muscles of the user have the conditions:

$$\text{Di} \underset{\text{Relaxation}}{\overset{\text{compression}}{\rightleftarrows}} \text{Df} \quad \text{(reversibly repeated motions)}$$

Di: initial compression depth of the gluteal muscles

Df: final maximum compression depth of the gluteal muscles

When the user repeats forward and backward motions of the upper body of the user on the top surface, reversible compression and relaxation motions of the gluteal muscles of the user are produced. By such motions, the anal canal and the anus of the user repeatedly retract and dilate; and at the same time, all lower regions of the rectum of the user are repeatedly compressed and relaxed as in the conventional massage mode.

By such repeating motions, excrement including hard feces and hard agglomerates in an accumulated state in the rectum of the user are discharged into the activation state and are discharged through the dilated anus and anal canal.

The action mechanism for the compression and the relaxation motions of the gluteal muscles on the top surface of the protrusions have the following relationships:

$$\left(\begin{array}{c}\text{Backward motion}\\ \text{and forward motion}\\ \text{of the upper body of}\\ \text{the user}\end{array}\right) \underset{\text{forward motion}}{\overset{\text{backward motion}}{\rightleftarrows}} \text{Di} \underset{\substack{\text{relaxation motion}\\ \text{(forward motion)}\\ \text{(reversible repeated motions)}}}{\overset{\substack{\text{compression motion}\\ \text{(backward motion)}}}{\rightleftarrows}} \text{Df} \longrightarrow$$

$$\left(\begin{array}{c}\text{all lower regions of}\\ \text{the rectum of the user}\end{array}\right) \underset{\substack{\text{relaxtion}\\ \text{(repeated motions)}}}{\overset{\text{compression}}{\rightleftarrows}} \left(\begin{array}{c}\text{by repeated motions, excrement}\\ \text{in the rectum of the user is}\\ \text{changed from the accumlated}\\ \text{state into the activation state}\end{array}\right) \longrightarrow$$

$$\left(\begin{array}{c}\text{By the repeated motions,}\\ \text{the anus and the anal canal}\\ \text{of the user retract and dilate}\end{array}\right) \underset{\substack{\text{(dilation)}\\ \text{relaxation}}}{\overset{\substack{\text{(retraction)}\\ \text{compression}}}{\rightleftarrows}} \left(\begin{array}{c}\text{When in dilation of}\\ \text{the anus and the anal}\\ \text{canal of the user}\end{array}\right) \longrightarrow \text{(discharge of the excrement)}$$

In this way, the action for the initial compression depth Di and the final compression depth Df for each of the gluteal muscles is repeated through the forward and backward motions of the upper body of the user. Motion changes from In order to effectively carry out the compression and relaxation motions of the gluteal muscles on the top surfaces, the twin protrusions are formed on the backward tail end central region of the seat of the toilet bowl as in the above required protrusion conditions, and the object of the present invention may be effectively accomplished.

DETAILED DESCRIPTION OF THE PREFERRED EMBODIMENT

FIGS. 1–9 explain a configuration and operation of a toilet seat in the embodiment according to the present invention.

Figure 1:
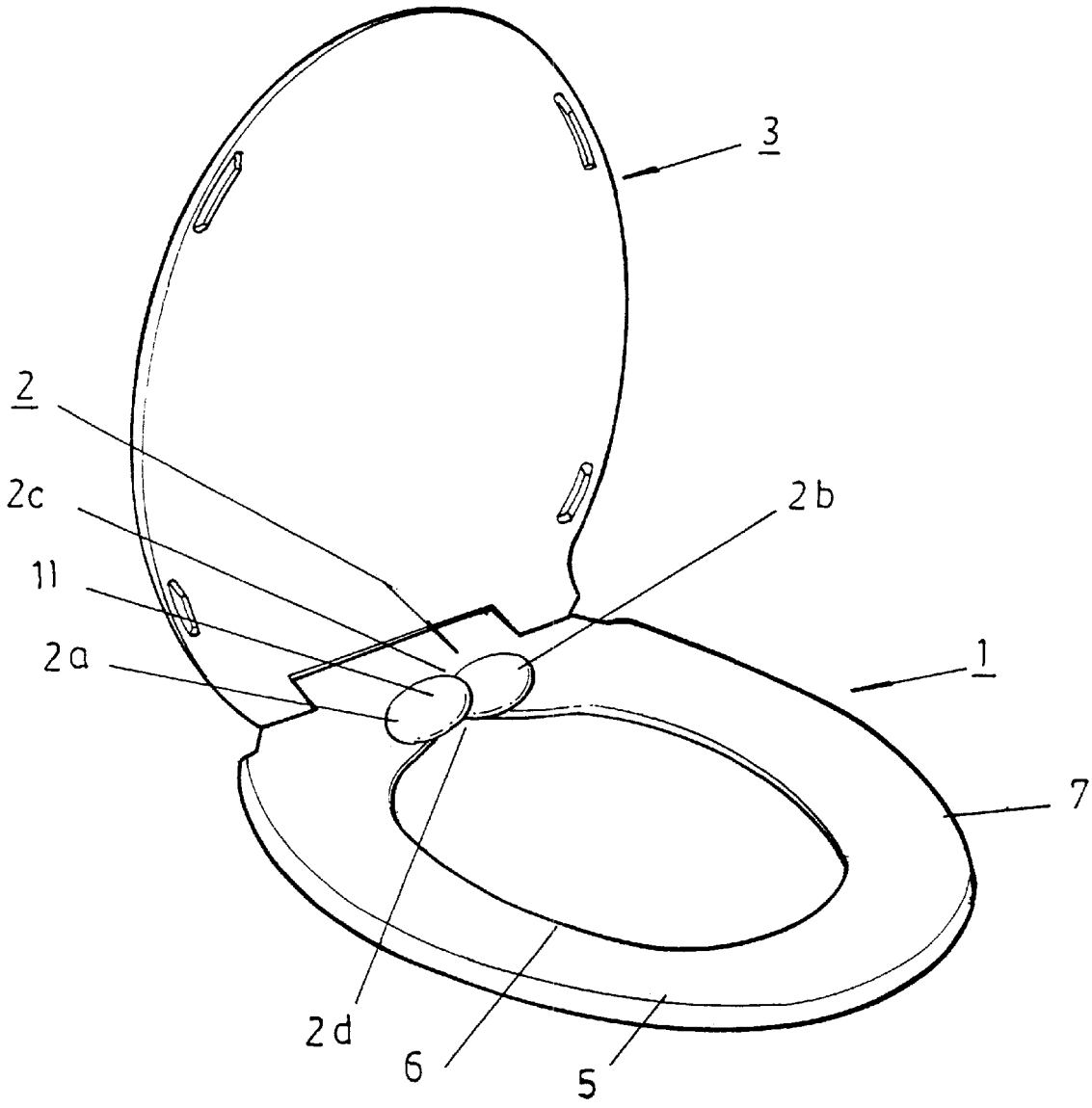
FIG. 1 shows a perspective view of a toilet seat to which twin protrusions having egg shapes are attached in an embodiment according to the present invention.
Figure 2:
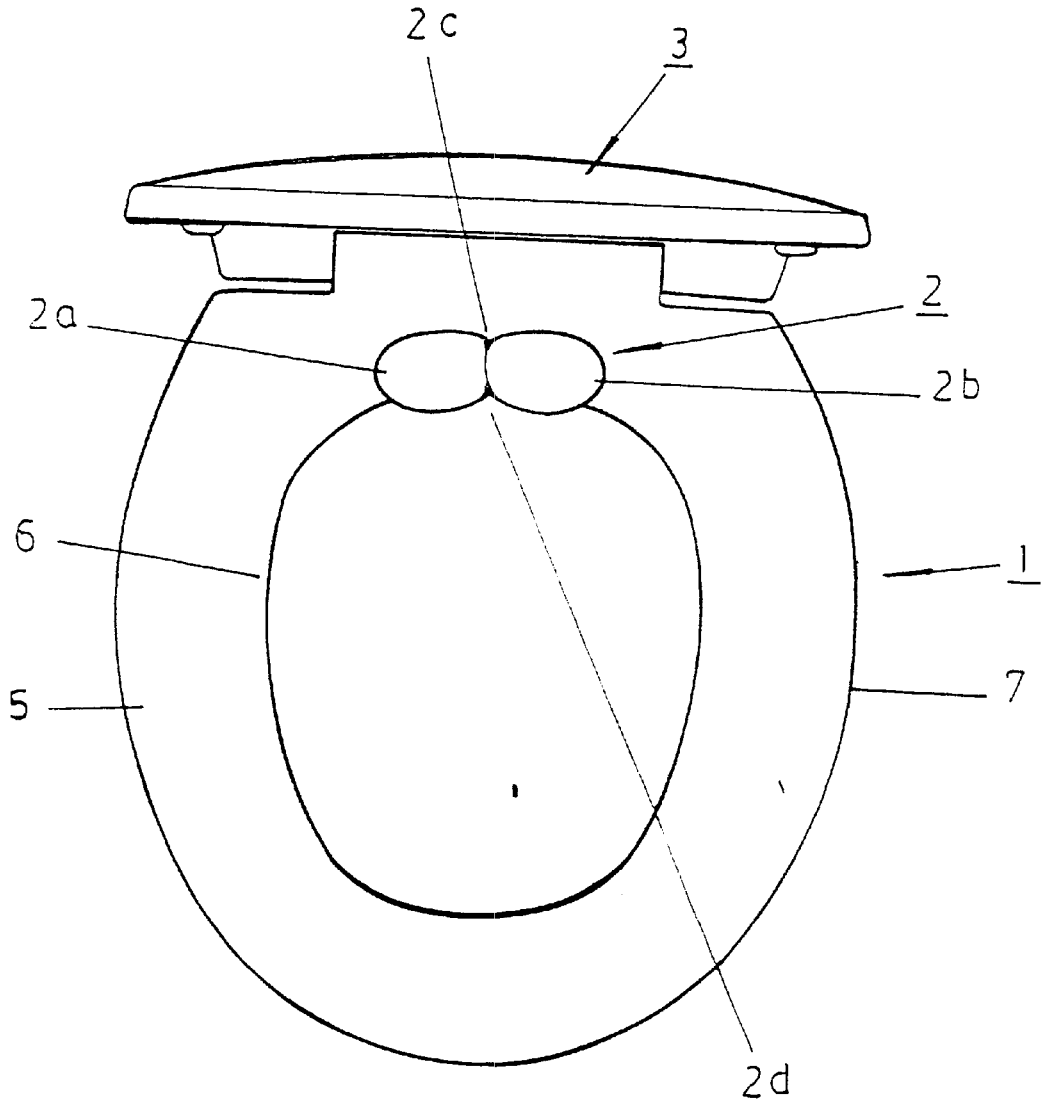
FIG. 2 shows a plan view of FIG. 1.

As shown in FIG. 1, the twin protrusions 2 protrude with egg shapes horizontally placed on a tail end central region of a toilet seat 1. The twin protrusions 2 have a left protrusion 2*a* and a right protrusion 2*b*, which have a symmetric structure.

A lid cover 3, which may protect the twin protrusions 2, is formed with a curved surface.

Figure 3:
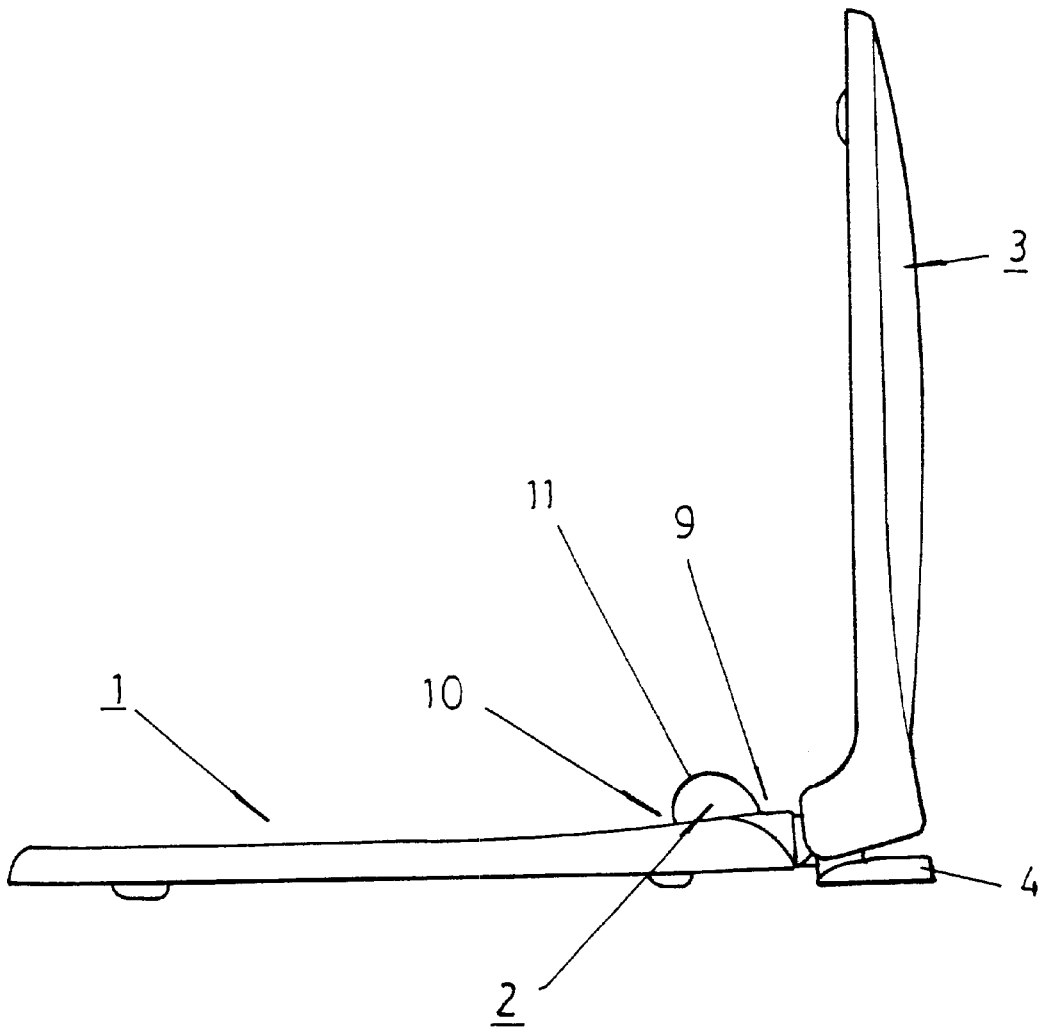
FIG. 3 shows a side view of FIG. 1.
Figure 5:
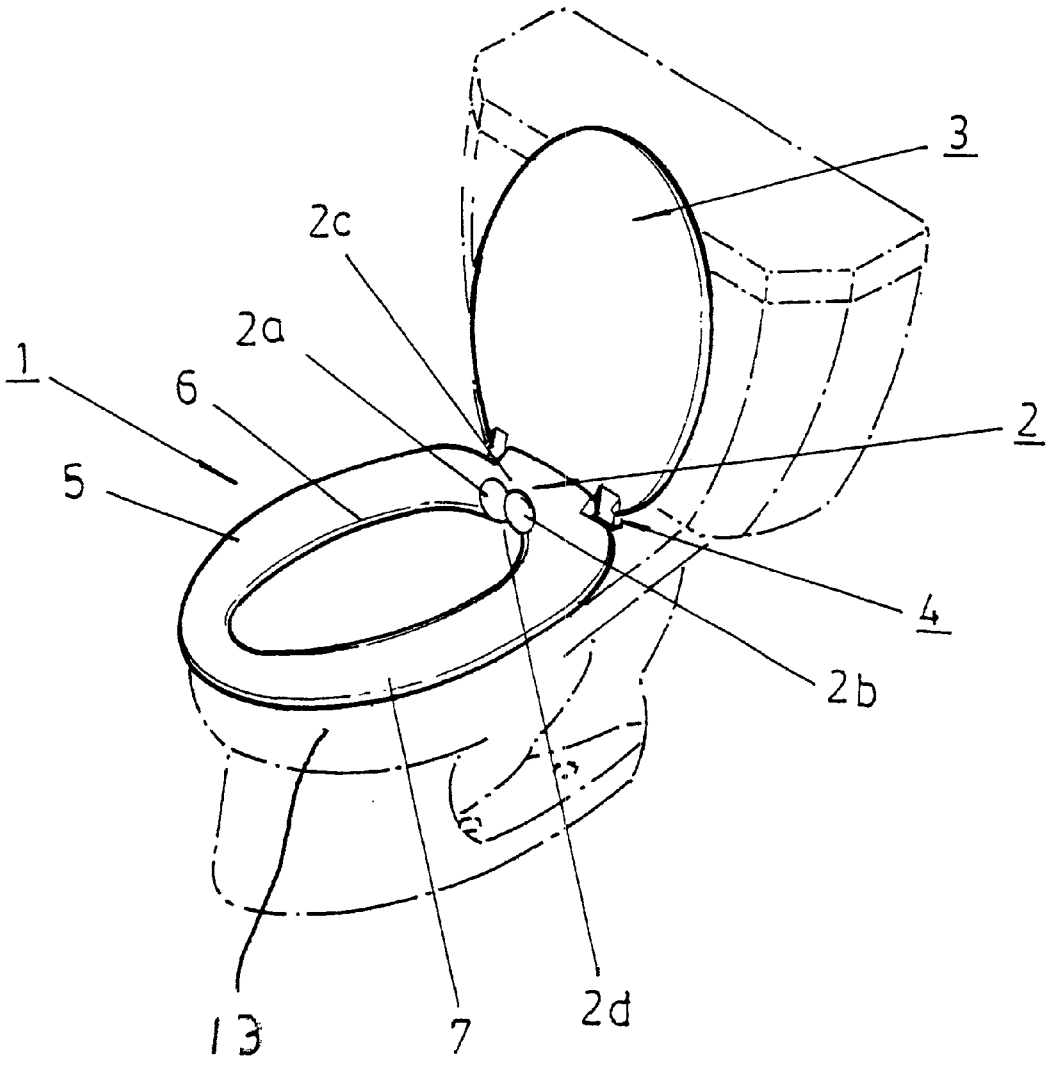
FIG. 5 shows a perspective view for a toilet bowl having the toilet seat of FIG. 1.

As shown in FIG. 3 and FIG. 5, connections 4 which are for operation by mutually connecting ends of the toilet seat 1 and ends of the lid cover 3 are formed.

The toilet seat 1 is formed at an easy grade in a direction of an inner peripheral part 6 on the toilet seat 1 having an oval shaped toilet seat circumference 5 in order to provide stability on gluteal regions for a person using the toilet bowl 13 (that is, the user).

An outer circumference 7 of the toilet seat 1 is formed as an oval and has a steep shape.

As shown in FIG. 3, the egg shaped twin protrusions 2, which project on a tail end central region of the toilet seat 1, are formed at an angle of 75° with respect to the front direction.

Figure 4:
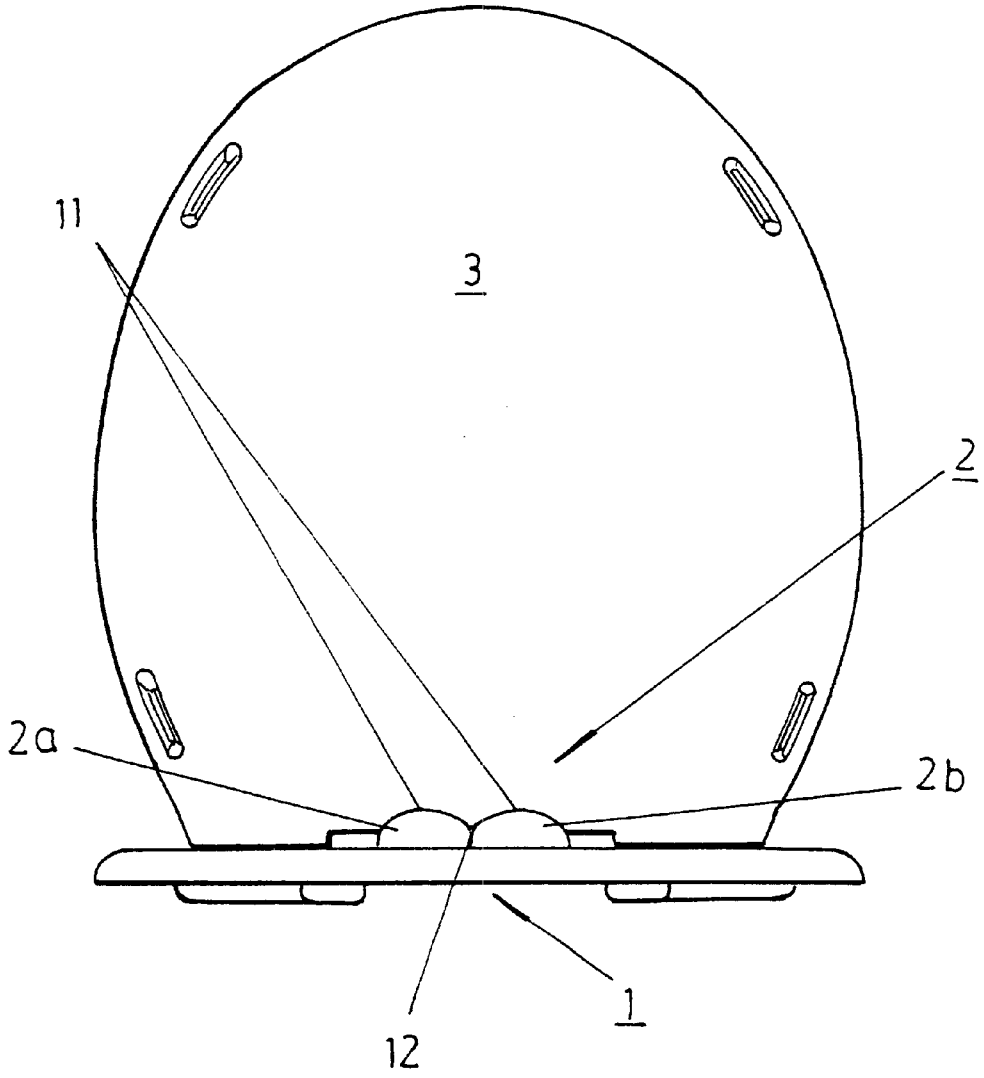
FIG. 4 shows a front view of FIG. 1.
Figure 7:
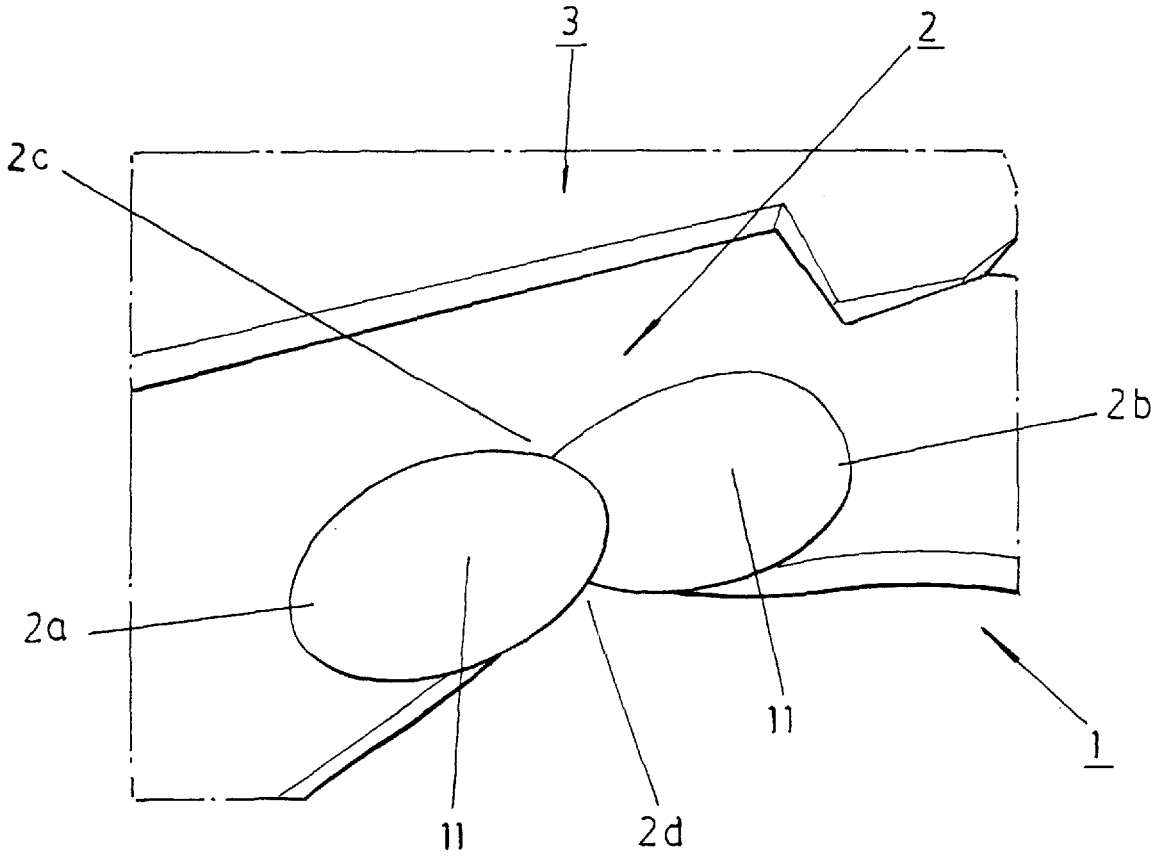
FIG. 7 shows an expanded perspective view for the egg shaped twin protrusions of FIG. 1.
Figure 8:
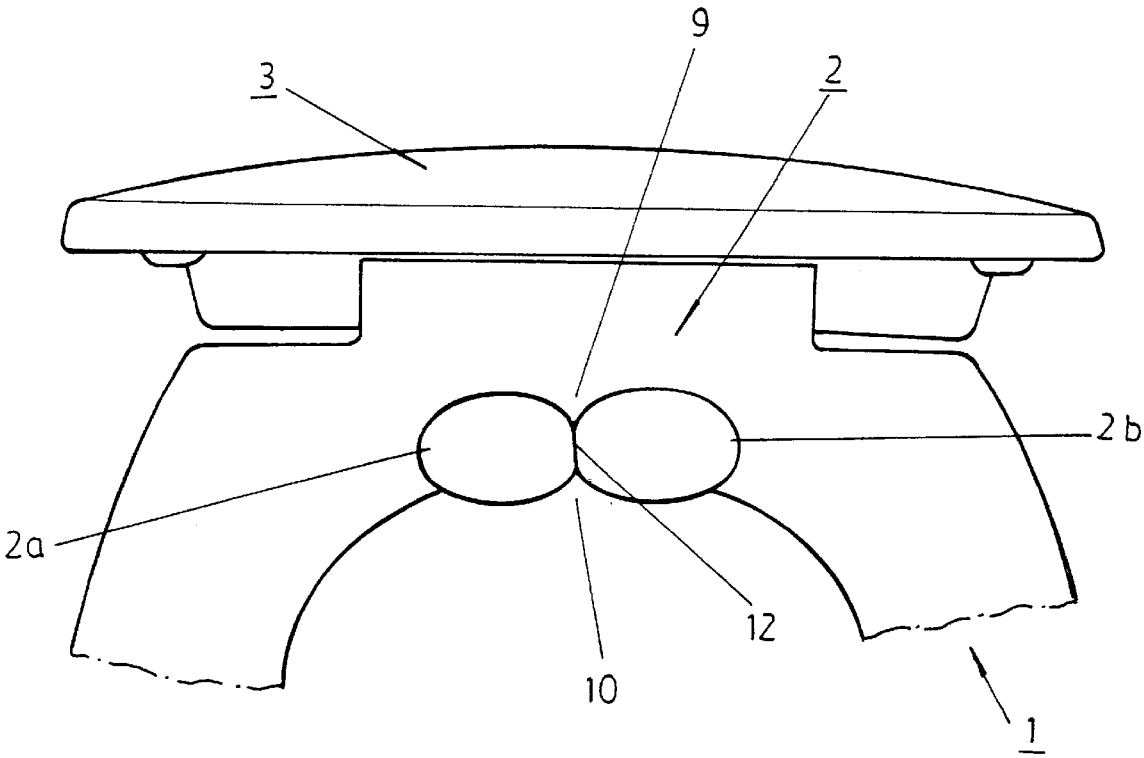
FIG. 8 shows an expanded view for a major portion of the egg shaped twin protrusions of FIG. 1.

As shown in FIG. 1, FIG. 4 and FIG. 8, the twin protrusions 2 comprise a left protrusion 2*a* and a right protrusion 2*b* having egg shapes. Top surfaces 11 are formed on the left protrusion 2*a* and the right protrusion 2*b*. A front groove 2*d* (or a protecting groove for the ischium and the pubis) is formed on a front bottom for an overlapping area formed by overlapping each of one surface of the protrusions 2*a* and 2*b*. A rear groove 2*c* (or a protecting groove for the coccyx) is provided on a rear bottom for the overlapping area and a boundary surface 12 is connected with the left protrusion 2*a* and the right protrusion 2*b* forming the front groove 2*d* and the rear groove 2*c*. The top surfaces 11 of the left and right protrusions 2*a* and 2*b* are provided with a circular arc having an angle of 180° as shown in FIG. 4 and FIG. 7.

The twin protrusions 2*a* and 2*b*, the rear groove 2*c*, the front groove 2*d* and the boundary surface 12 are formed and placed at the tail end central region of the toilet seat 1.

Figure 9:
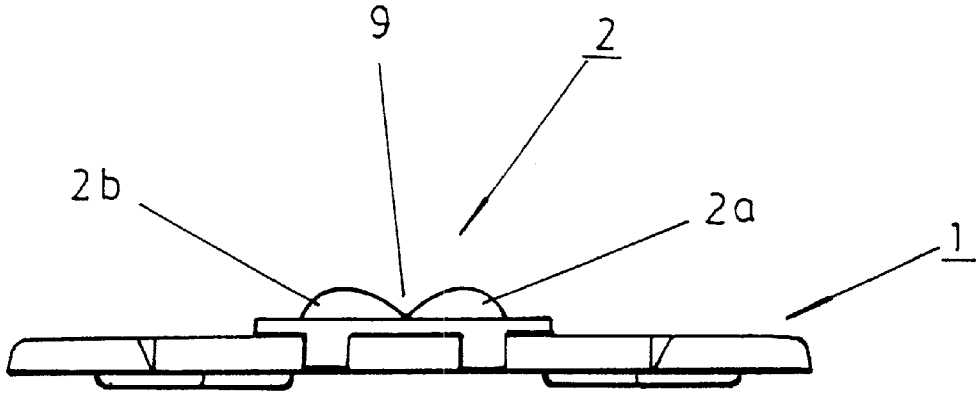
FIG. 9 shows a rear elevation for the twin protrusions of FIG. 1 with the toilet seat lid removed.

The rear surfaces of the protrusions 2*a* and 2*b* are placed at a slant angle of 85° on the central region of the seat 1, and the protrusions on the rear are formed as an inverse W shape (shape of flying wings for a gull) by formation of the rear groove 2*c* as shown in FIG. 9.

In addition, the front surface of the protrusion 2 having the front groove 2*d* is formed at a slant angle of 75°, and is placed on the central region of the seat 1.

When the user has an evacuation posture on the seat 1 of the toilet bowl 13, the evacuation posture on the top surfaces 11 of the protrusions 2*a* and 2*b* preferably is at a forward bending angle for the upper body of the user in a range of from 60° to 85°, and is NOT suitable for the bending angle of 90°.

When the evacuation posture has a forward bending angle of below 85° (in particular from 60° to 85°) the posture may be provided with stability for the evacuation.

As a result of clinical demonstrations, the protrusions 2*a* and 2*b* preferably have a range of from 1 inch to 2 inches in height. Further, each of the protrusions 2*a* and 2*b* preferably has a range of from 3 inches to 6 inches in a circumference of a circle as a result of clinical demonstrations. The protrusions 2 formed on the tail end central region of the seat 1 are integrally manufactured by known methods through injection molding.

Materials used for the seat 1 and the protrusions 2*a* and 2*b* are preferably thermoplastic resins, in particular, acrylonitrile-butadiene copolymer resins. The seat 1 and the protrusions 2 may have the same colors, for example white, green and the like. If required, the protrusions 2 and the seat 1 may be colored.

The protrusions 2*a* and 2*b*, including the rear and front grooves 2*c* and 2*d*, are integrally formed on the tail end central region of the seat 1 by injection molding with thermoplastic resins, such as acrylonitrile-butadiene copolymer resins.

In the case of the injection molding, the seat 1 and the protrusions 2 all use the same thermoplastic resins as materials and are formed by conventional injection molding.

In addition, the protrusions 2*a* and 2*b* may be formed as hollow elements, but to provide stability, the protrusions preferably are molded by complete filling of the plastic material in a mold during injection molding.

When a thickness for each of the gluteal muscles of the user is 1 inch, each of the diameters of the protrusions 2*a* and 2*b* is 1 inch. Each of the gluteal muscles can have a compressed depth of 1 inch on the top surfaces 11, and each of the protrusions 2*a* and 2*b* can have a thickness of the gluteal muscles when compressed and fitted on the top surface of each of the 1 inch diameter protrusions 2*a* and 2*b*. Further, when the thickness of both of the gluteal muscles of the user is about 1½ inches, each of the protrusions 2*a* and 2*b* preferably are formed to have 1½ inches in height and in diameter.

Each of protrusions 2*a* and 2*b* differ in size such as height, diameter and a circumference of a circle based on a physique (or physical constitution) of the user, in particular on the width and narrowness of each of the gluteal regions of the user and on thick and thin thickness for each of the gluteal muscles of the user. Such a size for each of the protrusions 2*a* and 2*b* has technical functions comparable to different sizes of shoes corresponding to a foot size of the user.

Figure 6:
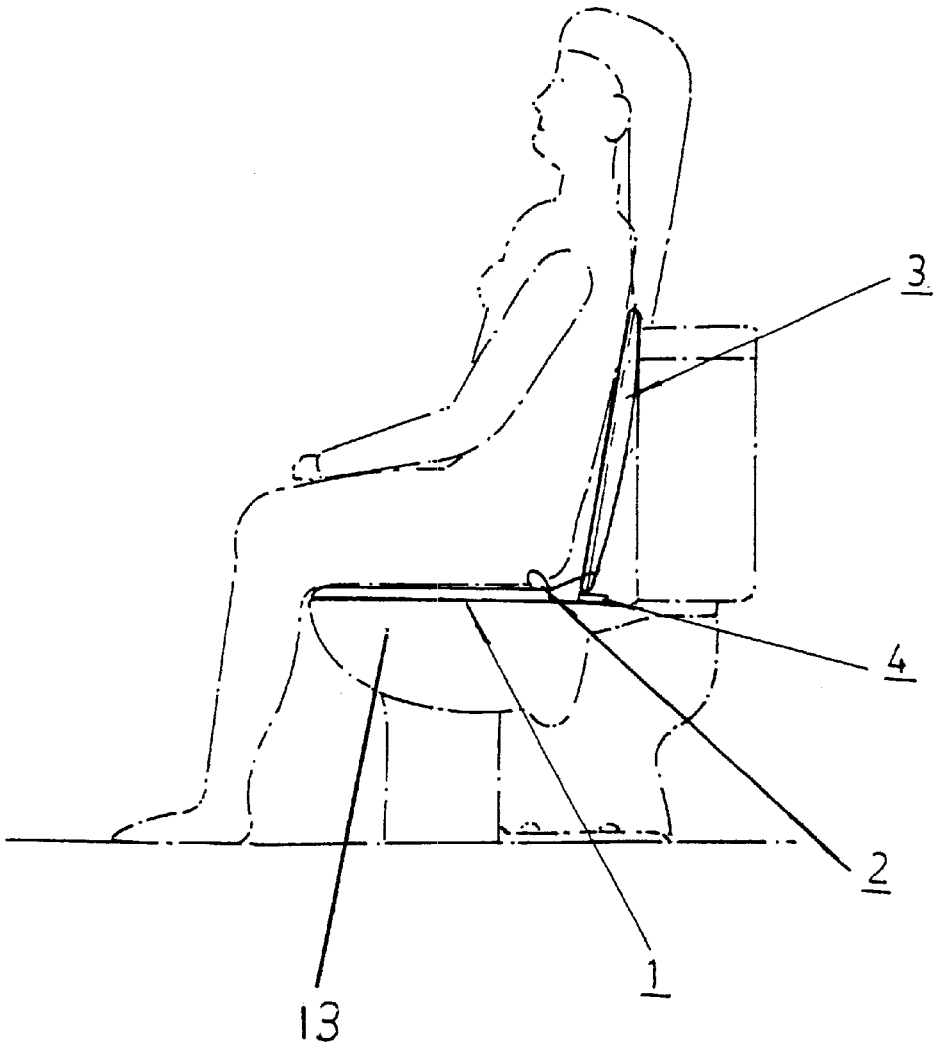
FIG. 6 shows a use state view for the toilet bowl having the toilet seat of FIG. 1.

As shown in FIG. 6, when the user needs to use the stool (feeling of evacuation) and wishes to defecate, each of the gluteal muscles of the user contacts on the top surfaces 11 of the protrusions 2*a* and 2*b*. At this time, the user repeats compression motion and relaxation motion by forward and backward motions of a upper body of the user on the surfaces 11.

In general, when the user wishes to defecate using the gluteal muscles of the user on the top surfaces 11, the user repeats compression and relaxation motions. The final compression depth Df can be 1½ inches when the protrusions 2*a* and 2*b* are 2 inches in height, and each of the gluteal muscles is compressed only up to the boundary surface 12.

Further, when compression and relaxation motions for each of the gluteal muscles of the user is repeated, the user begins to evacuate, and excrement drops into the interior space of the toilet bowl 13 just in front of the front groove 2*d* having a steep slope.

By repeating compression and relaxation motions for each of the gluteal muscles as described above, the motions are repeated on lower regions of the rectum of the user and a massage (a rubdown) as in the conventional finger-pressure treatment is carried out.

At this time, excrement accumulated in the rectum is changed from an accumulated state into an active state. Then, according to the need for the toilet (feeling for evacuation), the anus of the user is expanded by action of the anal canal of the user and at the same time the excrement is easily discharged out through the anal canal.

Accordingly, when the evacuation for the accumulated excrement in the rectum of the user is difficult, the excrement may be discharged, by using the protrusions, out from the anus with breathing or respiration in the normal state. Thus, application of strong pressure in the abdomen or belly by breathing is not required.

The front groove 2*d* which is formed by the left and right protrusions 2*a* and 2*b*, protects the pubis by avoiding contact and friction between the left and right protrusions and the pubis through the course of compression motion and relaxation motion for each of the gluteal muscles of the user.

Further, the ischium which is near the pubis is protected by the front groove 2*d* by avoiding contact and friction with each of the protrusions 2*a* and 2*b*.

In addition, the rear groove 2*c* formed on rear surfaces between the protrusions 2*a* and 2*b* protects the coccyx (coccygeal vertebrae) by avoiding contact and friction between the protrusions and the coccyx.

When each of the gluteal muscles in the gluteal regions placed on both sides of a posterior ridge of the user contact each other at the top surfaces 11 of the protrusions 2*a* and 2*b*, and a compression posture of the user is provided on the seat 1 of the toilet bowl 13, the coccyx is placed in the rear groove 2*c* and the pubis and the ischium are placed in the front groove 2*d*, respectively. Accordingly, they (coccyx, pubis, ischium) avoid contact and friction with the protrusions 2*a* and 2*b*.

The toilet bowl 13 includes the toilet seat 1 arranged by integrally forming the egg shaped twin protrusions on the tail end central region of the seat 1. When used, the present invention results in the following:

1. Each of protrusions 2*a* and 2*b* is formed with a horizontal egg shape, and each of the top surfaces 11 is provided with a circular arc having 180°. When compression and relaxation motions for each of the gluteal muscles on each of the gluteal regions are repeated on the top surfaces 11, user stability on the top surfaces is provided.

2. When the user has an evacuation posture and the compression and relaxation motions of the gluteal muscles are repeated on the top surfaces 11 by the user, bones such as the coccyx, the ischium, and the pubis are protected by avoiding contact and friction between the bones and the protrusions 2*a* and 2*b*, owing to formation of the front groove 2*d* and the rear groove 2*c* between the protrusions 2*a* and 2*b*.

3. When the user has an evacuation posture on the seat 1 of the toilet bowl 13, each of the gluteal muscles of the user is compressed on the top surfaces 11 by the backward motion of the upper body of the user, the anus of the user is dilated; and when each of the gluteal muscles of the user at the top surfaces 11 is returned to the original state (evacuation posture) by the forward motion of the upper body of the user, the anus is retracted. The dilation and retraction of the opening of the anus is repeated according to compression and relaxation motions of the gluteal muscles on the top surfaces 11. By action of the anal canal of the user, the rectum including the excrement of the user is acted upon upwardly and downwardly, and in the left and right direction, and the excrement is in an active state. By repeated action of the compression and relaxation motions for each of the gluteal muscles of the user, the excrement in the rectum is in a active state and is easily discharged.

4. When the user wants to carryout the evacuation, the defecation of the user may be easily worked during normal breathing by the user. Complex diseases produced or aggravated by application of strong pressure through respiration from the lower abdomen or belly may be prevented.

5. When the user has an evacuation, the excrement may easily be evacuated by the compression and relaxation motions of the gluteal muscles on the top surfaces 11 and a dyschezia which has difficult evacuation such as proctodynia, proctoparalysis and proctostasis may be solved.

6. The toilet bowl 13 including the toilet seat 1 having the protrusions 2*a* and 2*b* does NOT use power sources and manual tools. All users, such as the disabled and medical patients, may easily use the toilet seat. When necessary, the toilet bowl 13 having the toilet seat 1 according to the present invention can be used. When not necessary, the toilet seat 1 can be exchanged for a conventional toilet seat.

What is claimed is:

1. A toilet seat arrangement for a toilet bowl comprises a toilet seat, a lid cover protecting the seat, and connections which are operated by mutually connecting backward tail ends of the seat and the lid cover, wherein twin protrusions, each having an egg shape, are integrally formed on a backward tail end central region of the seat by molding and the twin protrusions comprise a left protrusion and a right protrusion, the protrusions including: top surfaces formed thereon with a circular arc of 180° and rear surfaces positioned at the central region of the seat at an angle of 85°, front surfaces of the protrusions being placed at the central region of the seat at an angle of 75°, and each of the protrusions being from about one inch to two inches in height and diameter and having a circular circumference from about three inches to six inches, wherein a front groove is formed in a front direction between the left protrusion and the right protrusion, a rear groove is formed in a rear direction between the protrusions, a boundary surface is formed by the grooves between the protrusions, and the lid cover is formed with a curved shape in order to protect the twin protrusions.

2. The toilet seat arrangement of claim 1, wherein the rear surfaces of the protrusions form an inverse W shape around the rear groove and the rear surfaces of the protrusions are rear curved surfaces, the front surfaces of the protrusions form a W shape and comprise front curved surfaces, and the front curved surfaces of the protrusions have a greater downward slope than the rear curved surfaces of the protrusions.

3. A toilet seat bowl including the toilet seat arrangement of claim 1.

4. The toilet seat arrangement of claim 1, wherein the protrusions are integrally formed on the tail end central region of the seat by injection molding using thermoplastic resins.

5. The toilet seat arrangement of claim 4, wherein the thermoplastic resins comprise acrylonitrile-butadiene copolymer resins, and the seat and the protrusions use the same thermoplastic resins and have the same color.

6. The toilet seat arrangement of claim 1, wherein compression and relaxation motions of each of the gluteal muscles of a user on the top surfaces of the protrusions are repeated 3 to 6 times, and repeating of the compression and relaxation motions on a lower region of the rectum of the user from the compression and relaxation motions of each of the gluteal muscles on the top surfaces produced by the forward and backward motion of the upper body of the user on the top surfaces, excrement in the rectum of the user is changed from the accumulated state into an activation state.

7. The toilet seat arrangement of claim 6, wherein the compression and relaxation motions in the rectum of the user have massaging effects on the rectum of the user.

8. The toilet seat arrangement of claim 6, wherein the compression and relaxation motions of each of the gluteal muscles on the top surfaces are repeated in a motion mode of a rocking chair, and compression and relaxation on the rectum of the user by the compression and relaxation motions of each of the gluteal muscles on the top surfaces are produced and provide the equivalent effect of a breathing or respiration action by acting as an artificial respiration method.

9. A toilet seat arrangement for a toilet bowl comprises a toilet seat, a lid cover protecting the seat, and connections which are operated by mutually connecting backward tail ends of the seat and the lid cover, wherein twin protrusions, each having an egg shape, are integrally formed on a backward tail end central region of the seat by molding, the twin protrusions comprising a left protrusion and a right protrusion, the protrusions including top surfaces formed thereon, a front groove formed in a front direction between the left protrusion and the right protrusion, a rear groove formed in a rear direction between the protrusions, and a boundary surface formed by the grooves between the protrusions, the protrusions having a symmetrical structure, the protrusions height, diameter and circular circumference having different sizes depending on the width of each of the gluteal regions of a user and the thickness of each of the gluteal muscles of the user, and the height and the diameter of the protrusions having size ratios corresponding to compressed depth of each of the gluteal muscles of the user and the thickness of each of the gluteal muscles of the user, and the lid cover is formed with a curved shape in order to protect the twin protrusions.

10. The toilet seat arrangement of claim 9, wherein the rear surfaces of the protrusions form an inverse W shape around the rear groove and the rear surfaces of the protrusions are rear curved surfaces, the front surfaces of the protrusions forming a W shape and comprising front curved surfaces, and the front curved surfaces of the protrusions have a greater downward slope than the rear curved surfaces of the protrusions.

11. A toilet seat bowl including the toilet seat arrangement of claim 9.

12. The toilet seat arrangement of claim 9, wherein the protrusions are integrally formed on the tail end central region of the seat by injection molding using thermoplastic resins.

13. The toilet seat arrangement of claim 12, wherein the thermoplastic resins comprise acrylonitrile-butadiene copolymer resins, and the seat and the protrusions use the same thermoplastic resins and have the same color.

14. The toilet seat arrangement of claim 9 wherein compression and relaxation motions of each of the gluteal muscles of the user on the top surfaces of the protrusions are repeated 3 to 6 times, and repeating of the compression and relaxation motions on a lower region of the rectum of the user from the compression and relaxation motions of each of the gluteal muscles on the top surfaces produced by the forward and backward motion of the upper body of the user on the top surfaces, excrement in the rectum of the user is changed from the accumulated state into an activation state.

15. The toilet seat arrangement of claim 14 wherein the compression and relaxation motions of each of the gluteal muscles on the top surfaces are repeated in a motion mode of a rocking chair, and compression and relaxation on the rectum of the user by the compression and relaxation motions of each of the gluteal muscles on the top surfaces are produced and provide the equivalent effect of a breathing or respiration action by acting as an artificial respiration method.

16. The toilet seat arrangement of claim 14 wherein the compression and relaxation motions in the rectum of the user have massaging effects on the rectum of the user.

* * * * *